United States Patent [19]

Stoakes

[11] 4,291,511

[45] Sep. 29, 1981

[54] STRUCTURAL ASSEMBLIES

[76] Inventor: Richard L. Stoakes, "Clouds", Northdown Rd., Woldingham, Surrey, England

[21] Appl. No.: 51,353

[22] Filed: Jun. 25, 1979

[30] Foreign Application Priority Data

Jun. 27, 1978 [GB] United Kingdom ..... 28049/78

[51] Int. Cl.[3] ..... E04B 1/76; E04B 2/42

[52] U.S. Cl. ..... 52/235; 52/220

[58] Field of Search ..... 52/220, 235

[56] References Cited

U.S. PATENT DOCUMENTS

| | | | |
|---|---|---|---|
| 2,976,970 | 3/1961 | Toney | 52/235 |
| 3,319,388 | 5/1967 | Olsen | 52/235 |
| 3,715,848 | 2/1973 | Jordan | 52/235 |

FOREIGN PATENT DOCUMENTS

| | | | |
|---|---|---|---|
| 674835 | 11/1963 | Canada | 52/235 |
| 1185870 | 2/1959 | France | 52/235 |
| 962790 | 7/1964 | United Kingdom . | |
| 1211881 | 11/1970 | United Kingdom . | |
| 1459401 | 12/1976 | United Kingdom . | |

OTHER PUBLICATIONS

Buildings for Industry, vol. 1, Henn, Iliffe Books Limited, London, 1965, p. 196.

*Primary Examiner—*

*Attorney, Agent, or Firm*—Hopgood, Calimafde, Kalil, Blaustein & Judlowe

[57] ABSTRACT

A structural assembly, e.g. a curtain-walled building, comprises load-bearing floor slabs at successive levels and a framework of the curtain wall has vertical mullion members through which it is secured to the floor slabs at a spacing from the floor slabs. Fire-resistant panels are interposed in the gaps to check the passage of smoke and flames between floors. The panels overlie the rear faces of the mullions over a depth substantially greater than that of the floor slabs and bear against said rear faces to reinforce the mullions against wind loads. Any residual spacing between the panels and the floor slabs can be closed by fire-resistant elements that also form service ducts.

10 Claims, 6 Drawing Figures

74
80
78
6
88a
88
70
20
84
86
4
82
90
82a
50
22
24
82
2
90
72
12
80
78
76
74

STRUCTURAL ASSEMBLIES

BACKGROUND OF THE INVENTION

This invention relates to structural assemblies and is particularly concerned with curtain walling or cladding and architectural constructions comprising such walling or cladding, and with building components for use in such constructions.

Typically, architectural constructions using curtain walling may employ horizontal load-bearing structural members at successive levels, e.g. in the form of concrete floor slabs cast in situ and possibly with vertical extensions or stands at the outer edge of each floor slab, to which members the curtain wall is secured by tie-back elements, such as metal ties so that it spans the successive levels to form an outer wall of the building, typically being many storeys high. Although the curtain walling does not have to bear the main vertical loads of the building it must be able to withstand wind force bending loads, for which purpose vertical mullions of the curtain wall usually have a deeper section than transoms extending between them, and their rear faces lie close to, although they are at a spacing from the floor slabs.

In this form of construction the means connecting the mullions to the floor slabs may substantially close said spacing between them but the relatively large gap between the floor slabs and the rear face of the curtain wall between mullions must be filled with a suitable fire-resistant material, because closure of the gap between the floor slabs and the curtain wall is needed to prevent or delay the progress of flames and smoke upwards from one floor to the next in the event of a fire. The inserted filling must moreover be supported in such a way that it is then held in place, when the stability and integrity of the curtain walling itself cannot be relied upon because of the effects of the fire. In other words, it is normally necessary to ensure that there is a fire-resistant barrier adequately held in place at each level of the main horizontal structural members in order to satisfy fire-resistance requirements.

It has been proposed (U.K. Pat. No. 962,790) to provide fire-resistant building panels as part of the curtain walling, these panels comprising parallel spaced asbestos boards with a heat-insulating filling between them and the outer board having a metal cladding on its external surface. To ensure they remain in place in the event of fire, these panels are required to be mounted directly to the floor slabs, which can result in fitting problems during erection of the curtain walling, and a gap is still left at the periphery of the floor slabs which must be filled by further fire resistant material to hinder the spread of flames and smoke between floors of the building.

SUMMARY OF THE INVENTION

According to one aspect of the present invention, in a structural assembly comprising a curtain wall framework having means securing it to a supporting structure comprising at least one floor slab or other horizontally extending load-bearing member, said framework being spaced from said member, there is provided a plurality of fire-resistant members interposed between the framework and said load-bearing member and supported from said member, said fire-resistant members overlying mullion members of said curtain wall framework. Said fire-resistant members may take the form of frames or panels and preferably extend vertically beyond the height of said horizontal structural member or the height of the main area of the said member.

According to another aspect of the present invention, in a structural assembly comprising a curtain wall framework having means securing it to a supporting structure comprising at least one floor slab or other horizontally extending load-bearing member, said framework having vertically extending mullion members through which wind loads on the curtain wall are to be transmitted to said at least one horizontal structural member and being spaced from said at least one structural member, said assembly also comprises a plurality of additional members that are interposed between said mullion members and said at least one load-bearing member and that each occupies a substantially greater vertical extent than its associated horizontal load-bearing member, said interposed members contacting and supporting the curtain wall framework over at least a substantial part of their vertical extent so as to reduce the bending forces on said mullion members of the framework generated by said wind loads.

It will be appreciated that in this aspect of the invention said interposed members may take also the form of frames or panels and may be so arranged as to combine both the supporting and fire safety functions referred to. Such members may conveniently be preformed from fire-resistant materials having suitable strength characteristics, for example being cast as blocks of glass-reinforced concrete. Advantageously the internal spaces of said members may be filled with a lightweight thermal insulation, so that they fulfil the further function of improving the insulation of the interior of the building.

Advantageously, the support and/or fire-resistant members are engaged and supported by tie-back elements connecting the mullions or other framework members to said at least one horizontal load-bearing member. Thus, they may have recesses or apertures through which said tie-back elements extend to support them. In a preferred arrangement, such recesses are so provided at their lateral margins that when they are placed over the tie-back elements they are supported both laterally and vertically.

For ease of construction, the assembly is so arranged as to allow some space to be left between the supporting and/or fire-resistant members and the adjacent outer edges of said at least one load-bearing member. It is possible for integral rearwards projections to extend from said members over the outer edges of said load-bearing member, leaving relatively small vertical gaps that can be filled by screed or sealing compounds, but alternatively fire-resistant closure elements can extend outwards from said load-bearing member to close the gap after assembly. In this latter case, preferably there are separate series of closure elements both at the upper and lower surfaces of the or each said load-bearing member. Said closure elements may have respective upper and lower portions that engage with correspondingly spaced portions of the supporting and/or fire-resistant members and it may be arranged that the elements form horizontally extending chambers or ducts above and/or below said load-bearing member. With respective series of elements above and below a floor slab that forms the load bearing member, and providing such ducts in both positions, the duct above the floor slab can contain space heating means and the duct below it can contain electrical cables, e.g. for ceiling lighting and other service installations of the building.

It may also be arranged that the supporting and/or fire-resistant members serve a further function as supports for inner glazing elements that form an insulating space between themselves and the glazing or other infill of the curtain wall framework or its outer face. If said members comprise heat-insulating material as already mentioned, the inner glazing elements will enhance the thermal insulation of the construction in the area of the wall construction beyond the extent of the members to give a more uniform insulating effect. The thermal insulation value of the structural assembly can be further improved if the infill at the outer face of the curtain wall framework is of a sandwich or double-glazed form.

Embodiments of the invention are described by way of example with reference to the accompanying drawings.

DESCRIPTION OF THE PREFERRED EMBODIMENTS

Figure 1:
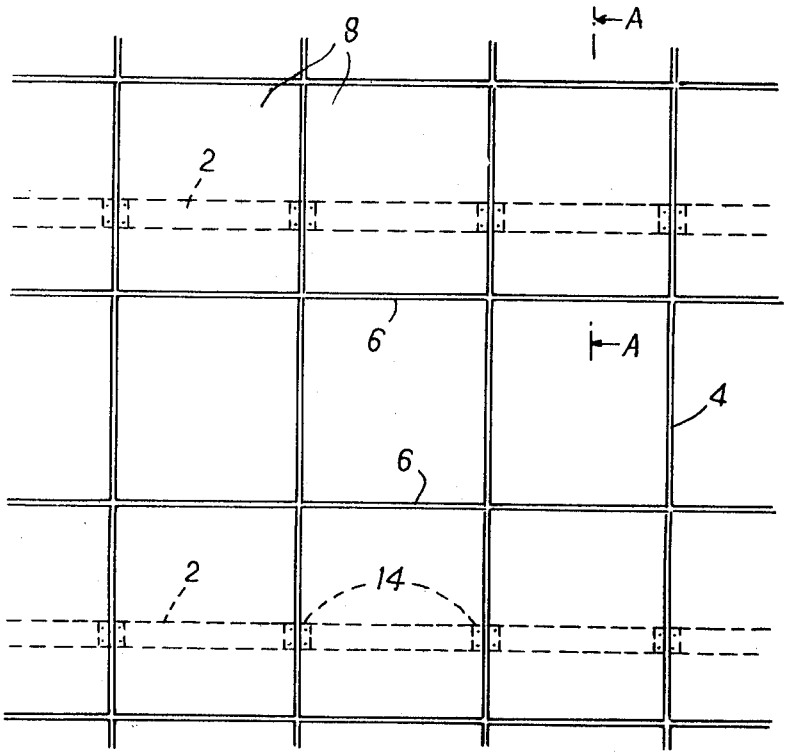
FIG. 1 is an outline front elevation of a part of a multi-storey structural assembly.

FIG. 1 illustrates in general outline a curtain wall assembly on a building structure comprising a series of load-bearing concrete floor slabs 2 each some 25 cm thick. The curtain wall comprises a framework, with members conveniently formed by extruded aluminium sections, including mullions 4 which may each extend vertically over the height of two or more floors of the building and shorter transoms 6 extending between and secured to adjacent mullions. A series of cells, each some 3 meters high, so formed by the framework contain an infill 8 of panels and/or window panes secured in place by peripheral sealing means 12 (FIG. 2) mounted on the framework. The curtain wall is itself connected to and supported by the floor slabs 2 through tie-back elements 14 to which the mullions are secured.

Figure 2:
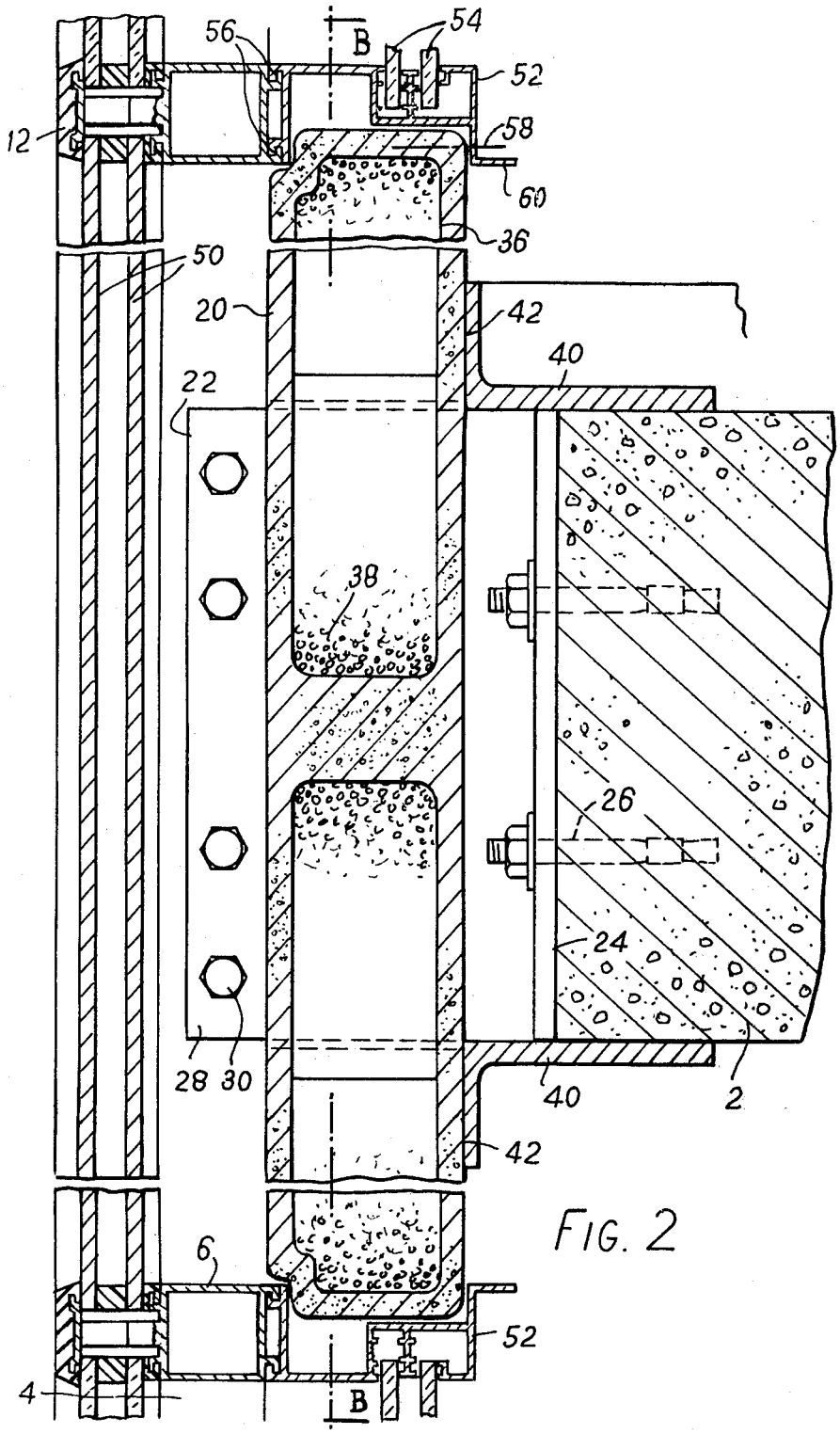
FIG. 2 is a sectional view to a larger scale on the line A—A in FIG. 1, FIGS. 3 and 4 are sectional views on the lines B—B and C—C in FIGS. 2 and 3 respectively.
Figure 3:
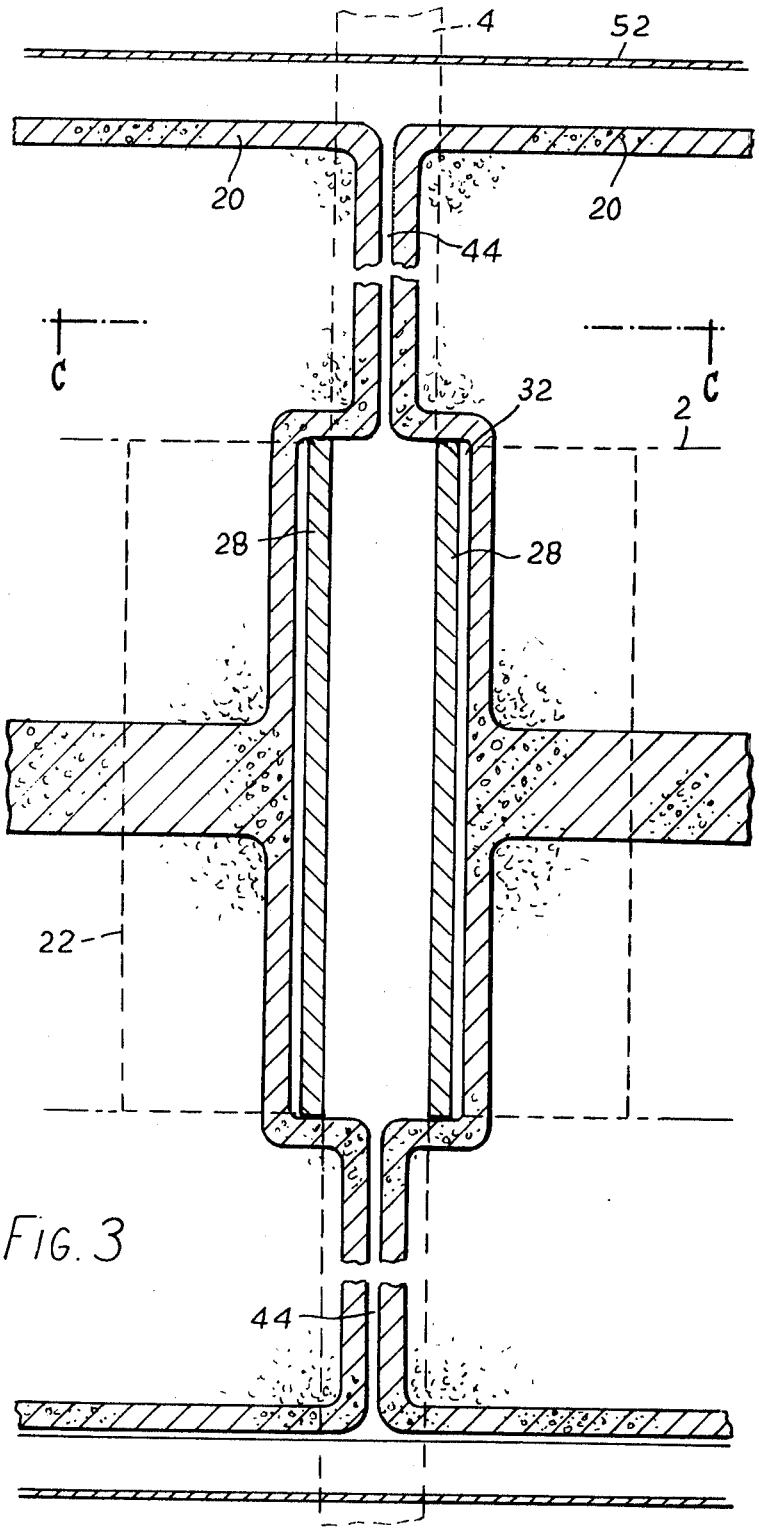
Figure 4:
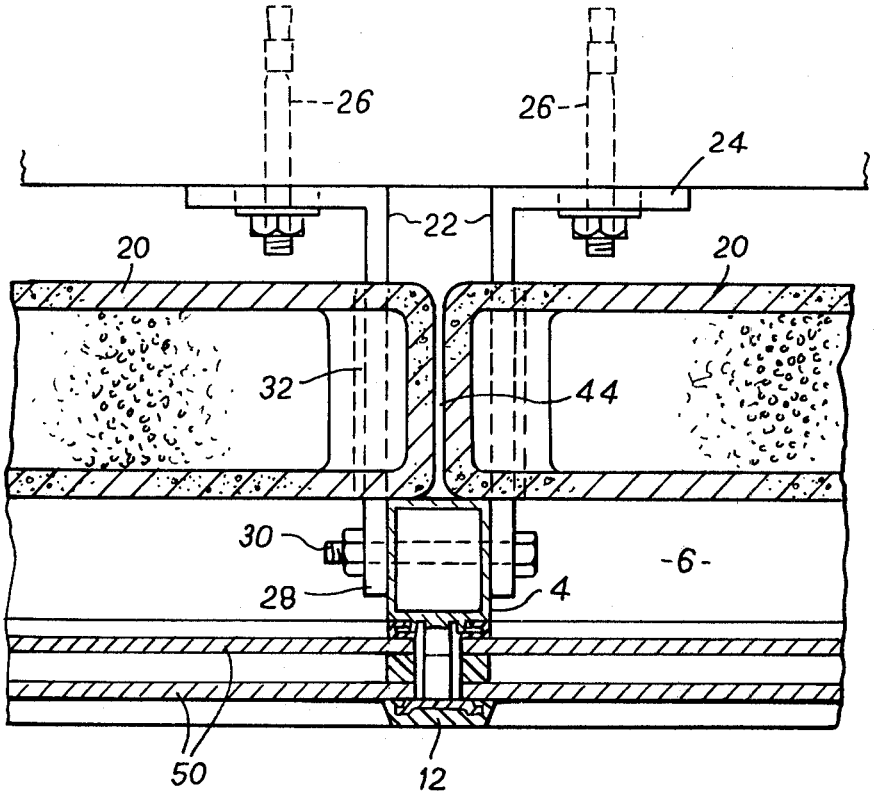

FIGS. 2 to 4 show how, in accordance with the present invention, additional members 20 are interposed between the curtain wall framework and the floor slabs, in this example being in the form of panels that extend both above and below the floor slabs and providing both support and fire resistance. The panels are mounted on mild steel angle brackets 22 which form the tie-back elements, having rear flanges 24 secured by bolts 26 to the edge of the floor slab and front flanges 28 projecting forwards of the panels and secured to the sides of the mullions by bolts 30.

The panels 20 form a continuous series along the edge of each floor slab. They have recesses 32 in their side edges intermediate their height, through which the front flanges 28 of the tie-back angle brackets project. Each panel extends between a pair of mullions 4 and is therefore held at both ends by the tie-back brackets 22. Since the bracket flanges 28 fit closely within the top and bottom of each recess 32 as well as its side face, the panels are securely located both vertically and laterally without relying upon the curtain wall framework, which will normally be a relatively light construction.

The panels are themselves of a fire-resistant nature, being precast from glass-fibre reinforced concrete with internal chambers 36 filled with a thermal insulation material 38 such as mineral wool. Because of their thin walls and the lightweight insulating infill, they are therefore relatively easily handled despite their size. As a further thermal insulation measure the interiors of the hollow-section mullions and transoms may also be filled with an insulant such as mineral wool.

There will normally be a gap between the rear of the panels and the outer edges of the floor slab, although not a large one, it being required mainly to allow for dimensional deviations due to construction tolerances. The gap is closed, after the panels are assembled in place, by respective upper and lower steel angle members 40 bolted to the floor slab 2. The provision of a sealing compound in the areas 42 between the front faces of the angle members and the panel and the areas 44 between the adjoining side edges of the panels themselves completes the closure of the gap between floor slab and curtain wall in a manner that affords a suitable degree of fire resistance.

The panels extend some substantial distance above and below the floor slabs and therefore can assume the function of conventional upstands and downstands at the edge of the slabs as flame barriers. The vertical extent of the panels will be dictated by architectural and fire requirements, but as an example of current building practice they may project approximately $1\frac{1}{2}$ m above and $1\frac{1}{2}$ m below the floor slab. It will be noted that they are located relative to the floor slabs by the mild steel brackets 22 and are therefore able to be supported stably in the event of fire even if the aluminium curtain wall framework and its infill are damaged.

The infill at the outer face of the curtain wall comprises sandwich and/or double-glazed panels 50. These panels can be mounted in known forms of sealing means 12, such as are described in British Pat. Nos. 1,211,881 and 1,459,401. In addition, the top and bottom edges of the panels provide support for auxiliary cill members 52 that mount internal glass sliders 54 so that a further sound and heat insulating space is provided between the sliders and the double glazing 50 mounted in the curtain wall frame. The auxiliary sill members 52 are extruded aluminium sections, like the curtain wall main frame members 4,6, and have a hooked engagement 56 with the transoms 6 as well as being secured by fixing screws 58 to the top and bottom edges of the panels 20. Conveniently both top and bottom cill members have the same section, which in the illustrated example includes a rear flange 60 that can serve as a deflector strip for a space-heating radiator placed adjacent the panels and/or as an attachment flange for duct covers (not shown).

In the main frame members of the curtain wall structure the mullions 4 and transoms 6 can have virtually identical sections, except that where provision is made for the auxiliary sill members 52 as described, the elements on the transoms for the hook engagements 56 preferably project rearwards of the mullion section. The co-acting elements of the auxiliary sill members can therefore extend continuously where these members cross the rear faces of the mullions, but it would alternatively be possible for the transoms to be identical to the mullions and for these elements to be interrupted or relieved at their junction with the mullions. In any event, because of the supporting effect of the panels the mullions can have a relatively small depth (front to rear) despite their substantial vertical extent and despite the fact that they provide the connections between the curtain wall and the load-bearing floor slabs.

This is because the panels lessen the effects on the mullions of wind loads acting on the face of the curtain wall. In a conventional curtain wall construction with the mullions supported only at the level of each floor slab, the complete span of each mullion between successive floor slabs relies upon its own bending stiffness to resist the wind loads imposed upon it. In the illustrated construction, with the rear face of each mullion engaging the considerable vertical extent of its abutting panel 20, the unsupported length of the mullion is considerably reduced (halved in the present example), so that there is a substantial reduction in the bending moment experienced. As a result, for a given wind loading requirement the depth of the section is able to be considerably reduced. In a similar way, the transoms are given support by the abutting edges of the panels.

Figure 5:
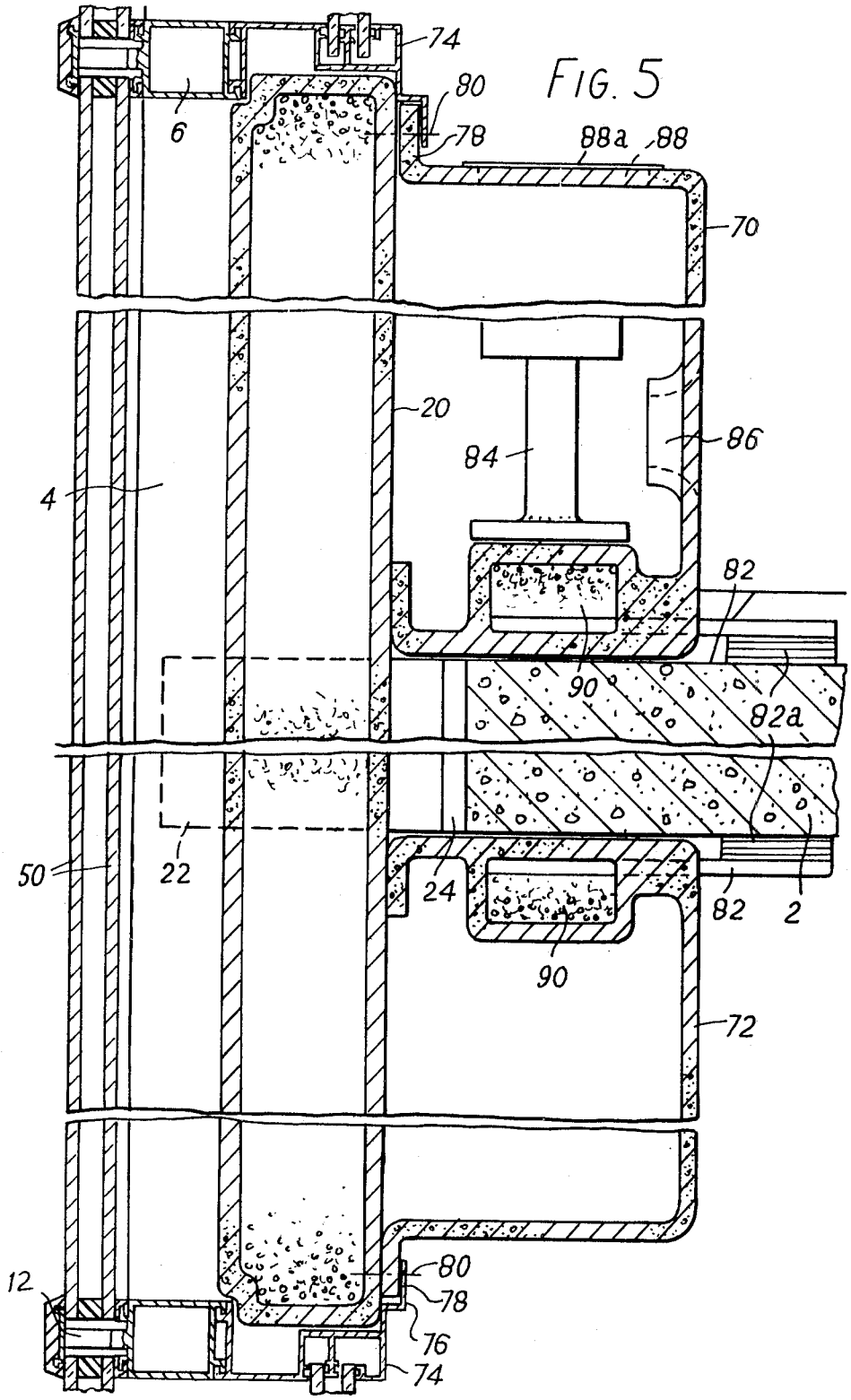
FIGS. 5 and 6 are each a sectional view in the same plane as the section A—A in FIG. 2 and illustrate two modified forms of the structural assembly of that earlier figure.

FIG. 5 illustrates a modification of the construction described above. In many respects identical parts are used and are indicated by the same reference numbers.

In the arrangement of FIG. 5 the curtain wall frame structure is tied back to the wall slabs 2 as already described and the panels 20 are mounted on the tie-back brackets 22 in the same way as before, but between the panels and the floor slabs, both above and below the floor slabs, there are duct members 70, 72 respectively, of substantially continuous cross-section which function partly as alternatives for the closure angle members 40 of the first-described embodiment. Like the panels 20 the duct members can be made of glass-reinforced concrete. Sill members 74 generally similar to the members 52 now each have a rear lip 76 overlying a flange 78 of their duct members, through which securing bolts 80 pass into the panel itself, while steel ties 82 cast into the duct members are used to secure the duct members to the upper and lower faces of the floor slabs 2, with the insertion of packings 82*a* as required. A sealing compound can be inserted in any gap between the duct members and the upper and lower faces of the floor slabs.

The upper duct members 70 can serve to enclose space heating means, indicated schematically at 84, for the interior of the building, and for this purpose there may be provided air flow openings such as are shown at 86 and 88 in the duct member. Where required these openings may be screened, as by louvered plate 88*a*. The lower duct member can similarly be provided with access openings, with screens or covers if required, and may serve as trunking for cable services and the like within the building, while its lower face can be adapted to mount a false ceiling structure (not shown). The upper and lower duct members can be formed by identical mouldings or castings and both are shown with an integral core 90 of a material able to provide a secure fixing for items such as the space heaters 84.

Figure 6:
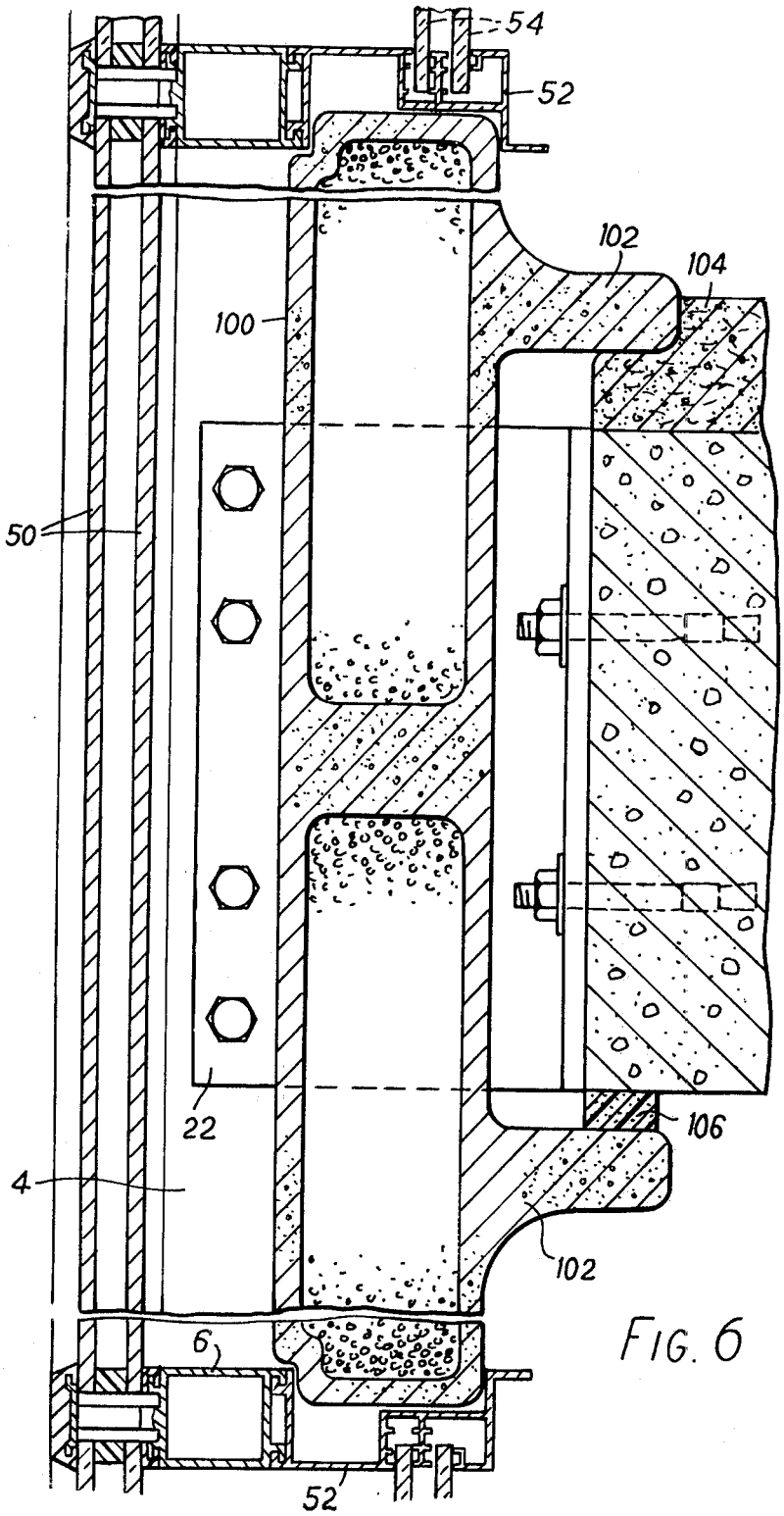

FIG. 6 illustrates another construction that is similar in many respects to that shown in FIGS. 2 to 4. In this instance, however, there are supporting and fire-resistant panels 100 that have integrally cast or moulded rear ribs or flanges 102 that make it possible to dispense with separate closure members for the gap at the edge of the floor slabs. In their other details the panels 100 can be identical to the panels 20. The spacing between the flanges 102 is slightly greater than the floor slab thickness, but the upper and lower gaps resulting from this are each less than the maximum gap at the edge of the floor slab that must be allowed for in the previously described construction.

On the upper face of the floor slab 2, there will normally be a screed layer 104 that provides a base for the final floor covering and this layer is spread up to and under the adjacent flange 102 to fill the gap there. On the under face of the floor slab a fireproof sealing material 106 is inserted to fill the gap.

What is claimed is:

1. A structural assembly comprising a supporting structure and a curtain wall framework, said structure comprising at least one horizontally extending load-bearing member, said curtain wall framework comprising a plurality of upwardly extending, laterally spaced mullion members, tie-back elements fixed to said mullion members and to said at least one load-bearing member to secure the framework to the supporting structure inner faces of said mullion members being located by said tie-back elements in a position outwardly spaced from said at least one load-bearing member, whereby regions of said inner faces are located opposite and adjacent said at least one load-bearing member, a plurality of fire-resistant members interposed in the space between the framework and said at least one member and supported through said at least one member, said fire-resistant members overlying said inner faces of the mullion members and forming a substantially continuous barrier between said framework and said at least one member, said barrier at least partly filling the space between said framework and said at least one member.

2. A structural assembly according to claim 1 wherein said fire-resistant members have a generally planar form extending vertically over said mullion inner faces beyond said regions opposite said at least one load-bearing member.

3. A structural assembly according to claim 2 wherein said fire-resistant members are in the form of hollow panels and a thermal insulation material is provided in the interior of said panels.

4. A structural assembly according to claim 1 wherein said fire-resistant members are in contact with said mullion members over at least a substantial part of the height of said mullion members for supporting the mullion members against bending loads thereupon due to wind forces.

5. A structural assembly according to claim 1 wherein said tie-back elements engage and support said fire-resistant members also.

6. A structural assembly according to claim 5 wherein recesses or apertures are formed intermediate the height of said fire-resistant members and comprise downwardly facing abutment faces, the tie-back elements extending through said recesses or apertures and said abutment faces resting on said elements to support the members thereupon.

7. A structural assembly according to claim 1 wherein there is a gap between said at least one load-bearing member, and the adjacent fire resistant members, said load-bearing member having upper and lower regions and fire-resistant closure elements extending from at least one of said regions to close the gap between said at least one load bearing member and the adjacent fire-resistant members.

8. A structural assembly according to claim 7 wherein at least one horizontally extending chamber or duct is provided by the fire-resistant closure elements for use as a service duct and is disposed inwardly of the curtain wall framework and at least partly at a different level from that of the associated horizontally extending load-bearing member.

9. A structural assembly according to claim 1 further comprising inner glazing members supported by said fire-resistant members, respective infills mounted in said curtain wall framework and said inner glazing member enclosing an insulating space between them.

10. A structural assembly comprising a supporting structure and a curtain wall framework, said structure comprising at least one horizontally extending load-bearing member, tie-back elements fixed to said framework and to said member to secure the framework to the supporting structure, and said curtain wall framework comprising a plurality of upwardly extending laterally spaced mullion members connected by said tie-back elements to said at least one load-bearing member and through which wind loads resisted by the curtain wall framework are transmitted to said supporting structure, a plurality of additional members being interposed between said mullion members and said at least one load-bearing member, each said interposed member occupying a substantially greater vertical extent than its associated horizontal load-bearing member, said interposed members contacting and supporting the curtain wall framework over at least a substantial part of their vertical extent so as to reduce the bending forces on said mullion members of the framework generated by said wind loads.

* * * * *